US006684544B1

(12) United States Patent
Buettell

(10) Patent No.: US 6,684,544 B1
(45) Date of Patent: Feb. 3, 2004

(54) MAGNETIC CARD HOLDER

(75) Inventor: Bruce J. Buettell, Fullerton, CA (US)

(73) Assignee: J.A.M. Plastics, Inc., Anaheim, CA (US)

( * ) Notice: Subject to any disclaimer, the term of this patent is extended or adjusted under 35 U.S.C. 154(b) by 0 days.

(21) Appl. No.: 10/152,307

(22) Filed: May 20, 2002

(51) Int. Cl.[7] ..... G09F 3/18

(52) U.S. Cl. ..... 40/661.01; 40/661; 40/661.04; 40/1.5

(58) Field of Search ..... 40/661, 661.01, 40/661.04, 600, 621, 1.5

(56) References Cited

U.S. PATENT DOCUMENTS 3,295,235 A * 1/1967 Tauber ..... 40/1.5
3,931,688 A * 1/1976 Owens ..... 40/1.5
4,236,331 A * 12/1980 Mattson ..... 40/600
4,593,736 A * 6/1986 Morita ..... 150/147
4,930,234 A * 6/1990 Schmidt ..... 40/1.5
5,283,966 A * 2/1994 Rader et al. ..... 40/1.5
5,347,733 A * 9/1994 Whittington ..... 40/600
6,006,455 A * 12/1999 Miller ..... 40/661
6,282,760 B1 * 9/2001 Mars ..... 24/303
6,446,372 B1 * 9/2002 Reeves ..... 40/661.01

OTHER PUBLICATIONS

Catalog—J.A.M. Plastics, Inc.—Oct. 1, 2000—"The Badge Holder Specialist" in 4 pages.

* cited by examiner

*Primary Examiner*—Gary Hoge
(74) *Attorney, Agent, or Firm*—Knobbe, Martens, Olson & Bear, LLP

(57) ABSTRACT

A magnetic card holder is disclosed that allows users to display cards on their clothing comfortably and without damage to their clothing. Lightweight, thin, and strong neodymium magnets used in this card holder provide a desirable combination of weight, size, and performance. The magnetic forces produced by the included magnets are confined substantially within the magnetic card holder and therefore have no damaging magnetic effects on cards placed in or near the card holder.

47 Claims, 2 Drawing Sheets

MAGNETIC CARD HOLDER

BACKGROUND OF THE INVENTION

1. Field of the Invention

The present invention relates to a magnetic card holder that allows the display of an inserted card on a user's clothing.

2. Description of the Related Art

Card holders are common in offices, conventions, and events where people need to display identification cards, credentials, badges, and other things. Typically, card holders attach to a person's clothing and remain on display while the person is in a designated area.

Card holders are available with a variety of means for attaching them to clothing. Some examples of attachment devices include safety-pins, clips, stickers, and magnets. Each type of attachment on the market today has advantages and some limitations.

Safety pins are effective to prevent cards from falling off or being lost. One drawback of safety pins is the hole they leave in the users clothing. Many people prefer not to damage their clothing with a safety pin.

Clip-type card holders do not leave holes in clothing, but are typically less effective than other types of attachments. Clips are available in many configurations and some are more effective than others. Clips often wrinkle clothing and produce an uncomfortable pinch in clothing.

Stickers are effective and are usually not uncomfortable, but stickers tend to be effective only for a limited number of uses. For everyday use, stickers are not as practical as other means of displaying identification information.

Magnetic card holders have been on the market for some years but have experienced limited market success. Magnetic holders typically attach to a person's shirt pocket, belt, pants pocket, or collar. Advantages of an ideal magnetic card holder include long life, ease of use, and the ability to attach without altering the appearance of a person's clothing. Magnetic card holders on the market today, however, are less than ideal for a number of reasons.

Most magnetic card holders on the market today have two or more magnets, usually made of metal or ceramics. In most designs, one magnet is positioned on the inside of a person's pocket or clothing with another magnet attached to the portion of the holder remaining on the outside of the user's clothing. The layer of the user's clothing positioned between the inside and outside portions of the card holder is gripped by means of the magnetic attraction between the two portions. The magnets used in today's magnetic card holders typically weigh about one to two ounces and produce a magnetic flux of approximately 600 to 800 gauss. Especially when attached to relatively thick clothing, today's magnetic card holders lack sufficient magnetic flux to provide a secure attachment. Also, the weight and thickness of these magnetic card holders may be burdensome when worn on a person's pocket or shirt collar.

Another limitation of most magnetic card holders on the market today is that they cannot be used to hold cards having magnetic stripes or other devices which are sensitive to magnetic forces. Testing has shown that the magnets in the holders will destroy the information contained on such cards if the cards are exposed to a magnetic flux of approximately 70 gauss or greater. For the same reason, credit cards, ATM cards, other such cards, and computer diskettes cannot be carried in a pocket while these magnetic card holders are attached to the pocket.

Notwithstanding the many different types of magnetic card holders, it is believed that there is a need for an improved magnetic card holder that is lightweight, holds effectively, and does not interfere with the information on cards.

SUMMARY OF THE INVENTION

In accordance with the present invention, a magnetic card holder is provided that is made of plastic, two lightweight magnets, a magnet shield, and a metal plate. Two small neodymium magnets allow for a compact, lightweight design with ample magnetic force. One of the poles of each magnet is attached to one side of the magnet shield. The magnet shield limits substantially all of the magnetic flux that would otherwise be emitted from the attached poles. Thus, the effective magnetic flux is directed in the opposite direction, toward the metal plate housed in the card pocket portion of the holder. The magnets and shield are contained in a tab portion of the holder which is designed to be positioned inside a user's clothing.

The metal plate is attracted to the magnets to provide the connection to a user's clothing. The metal plate also serves to limit the magnetic force emitted by the magnets in its direction. The plate in combination with the plastic walls of the holder shield any card inserted in the card holder from the magnetic flux. The metal plate is designed to be as lightweight and thin as possible while still sufficiently shielding the card pocket and still being sufficiently attracted by the magnets. Similarly, the magnet shield is designed to be as small and as lightweight as possible while still absorbing substantially all of the magnetic force that would otherwise be emitted from the card holder in the direction of the shield.

DETAILED DESCRIPTION

Figure 1:
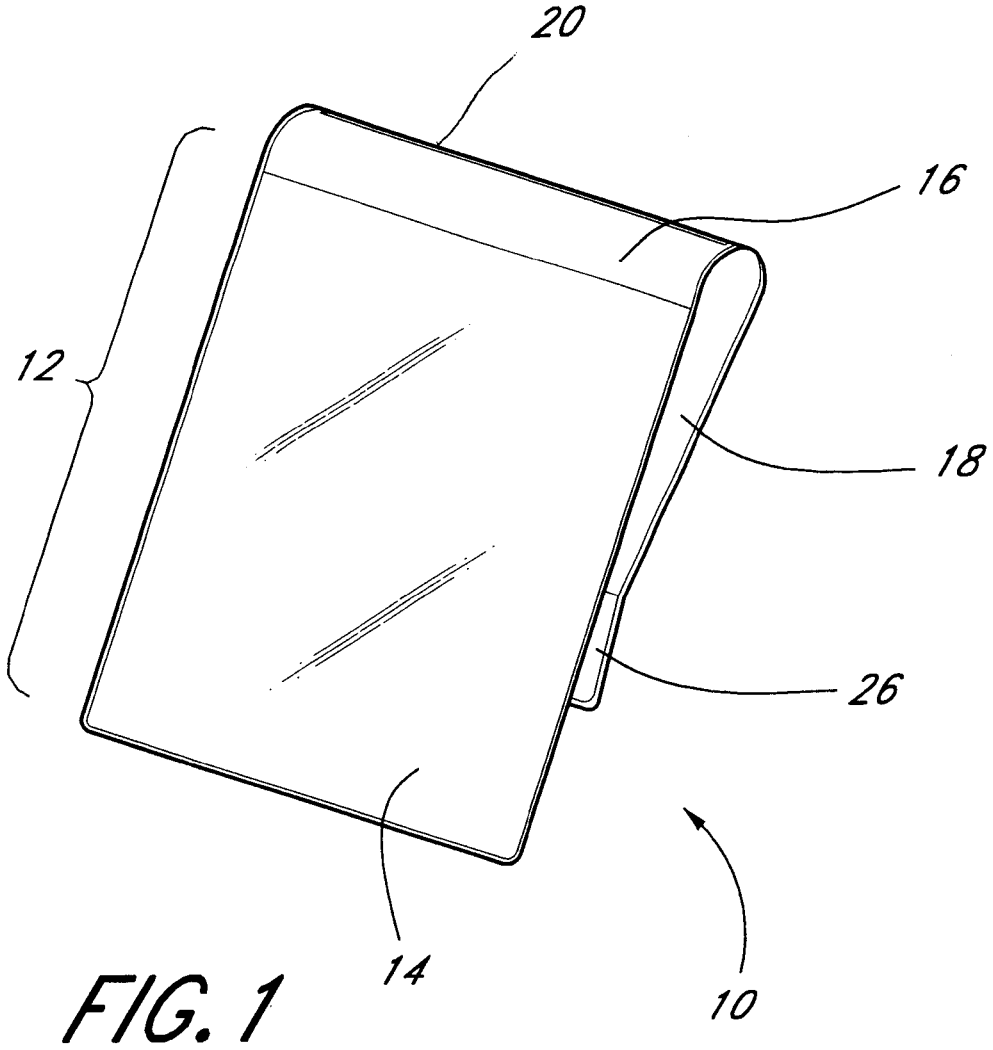
FIG. 1 is a perspective view of the magnetic card holder.
Figure 2:
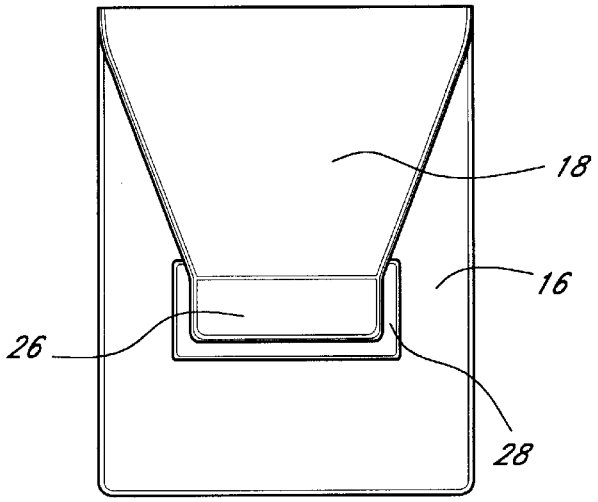
FIG. 2 is a back view of the magnetic card holder.
Figure 5:
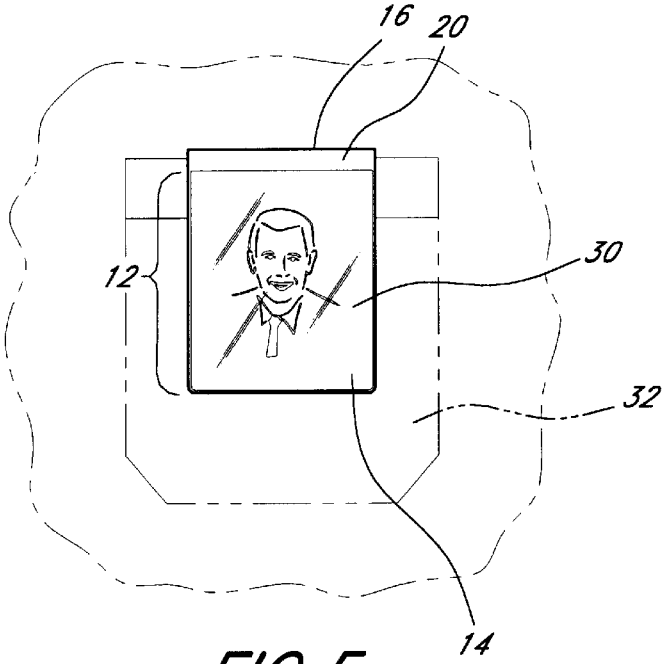
FIG. 5 is a view of the magnetic card holder as it can be worn on a person's shirt pocket.
Figure 6:
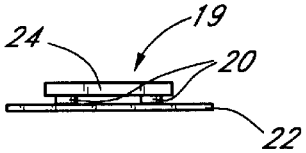
FIG. 6 is a side view of the magnet component and plate.
Figure 7:
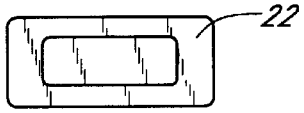
FIG. 7 is a top view of the magnet component and plate.

FIG. 1 illustrates a magnetic card holder 10 preferably made from flexible plastic. FIG. 1 shows that the magnetic card holder includes a pocket 12 defined by a transparent front wall 14 and a back wall 16. The pocket is designed to accept a card 30 as shown in FIG. 5.

FIG. 1 shows a tab 18 connected to an upper edge 20 of the back wall 16. The tab 18 allows the card holder to be worn on a user's clothing, for example the shirt pocket 32 in FIG. 5, by positioning the tab 18 on the inside of a user's clothing overlying the pocket on the outside of the clothing. A magnetic component 19 preferably including two magnets 20 is sealed in a compartment 26 on the tab to attract a plate 22 sealed in a compartment 28 in the back wall 16 of the pocket 12. Of course, a reverse arrangement could be employed. This magnet-to-metal attraction provides the force required to secure the card holder 10 in place. In one preferred embodiment, the magnet component 19 produces a flux directed toward the pocket 12 of approximately 3220 gauss, requiring a pulling force of approximately two pounds to separate the tab 18 from the pocket 12.

Figure 3:
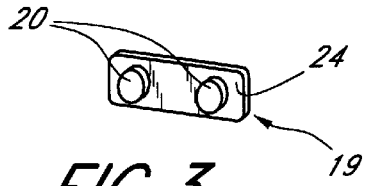
FIG. 3 is a view of the magnet component.
Figure 4:
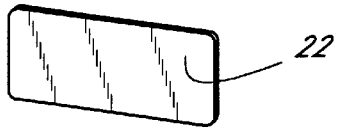
FIG. 4 is a view of the plate.

One pole of both magnets 20 is attached to one side of a magnet shield 24 as shown in FIG. 3. The shield 24 blocks the magnetic flux produced in the direction of the shield, thus focusing the magnetic flux in the direction of the plate 22 on the non-shielded side of the magnets 20. In initial testing of the device, the magnetic flux on the shielded side of the magnetic shield 24 measured in a range of only approximately zero gauss to 26 gauss.

The low total magnetic permeability of the plate 22 and the plastic compartment 28 in which it is sealed ensure that substantially none of the magnetic flux produced in that direction can be measured in the pocket 12 of the card holder 10. Testing shows that the preferred embodiment allows a range of only approximately one gauss to 23 gauss to be measured inside the pocket 12.

In another aspect, the magnets 20 are preferably cylindrical neodymium magnets each with a diameter of approximately ¼ inch and a thickness of approximately ⅛ inch. The magnets 20 are attached to the magnet shield 24 with their centers spaced approximately ⅝ inch apart, as shown in FIG. 8. The shield preferably measures approximately ⅜ inch by 1 inch with a thickness of approximately 1/16 inch. The combined weight of the magnets 20 and shield 24 is only approximately 3/10 ounce.

The plate 22 in one embodiment is made of steel, weighs approximately ⅕ ounce, is approximately less than 1/20 of an inch thick, and measures approximately 17/16 inches by 11/16 inch. The design of the metal plate 22 features a large surface area to allow for instances in which the magnets 20 may be aligned off-center of the plate 22. In the preferred embodiment, the total weight of the magnetic card holder 10 is approximately ⅘ ounce. Thus, the weight of the magnet component 19 is advantageously less than half that of the total weight of the magnetic card holder 10.

While the invention has been described in terms of a preferred embodiment, it will be understood that other arrangements fall within the scope of the following claims.

What is claimed is:

1. A magnetic card holder comprising a pocket for receiving a card; a tab attached to a backside of the pocket; a magnet component comprising two magnets; each magnet having two poles; said magnet component producing a magnetic flux of at least 2000 gauss; a magnet shield attached to one pole of each magnet to limit flux through the shield, a magnetic flux of at most 70 gauss being measurable on the opposite side of said shield; and a plate attracted to said magnet component, said magnet component and said plate being aligned in the holder so that the plate is captured by the magnet component.

2. The holder in claim 1 in which the weight of said magnet component is less than half of the weight of the card holder.

3. A magnetic card holder comprising a pocket for receiving a card; a tab attached to a backside of the pocket; a magnet component comprising two magnets; said magnets having two poles; said magnet component producing a magnetic flux of at least 2000 gauss; one side of a magnet shield attached to one pole of each magnet to limit flux through the shield, said magnets being positioned such that the magnetic flux of each magnet interacts with the other magnet's flux to direct and limit the magnetic flux produced by said magnet component; and a plate attracted to said magnet component, said magnet component and said plate being aligned in the holder so that the plate is captured by the magnet component.

4. A magnetic card holder comprising a pocket for receiving a card; a tab attached to a backside of the pocket; a magnet component comprising two cylindrical magnets with each having a diameter of approximately ¼ inch and a thickness of approximately ⅛ inch mounted on one side of said magnet shield with centers spaced approximately ⅝ inch apart; said magnets having two poles; said magnet component producing a magnetic flux of at least 2000 gauss; a magnet shield attached to one pole of each magnet to limit flux through the shield; and a plate attracted to said magnet component, said magnet component and said plate being aligned in the holder so that the plate is captured by the magnet component.

5. A magnetic card holder comprising a plastic pocket for receiving a card; a plastic tab attached to a backside of the pocket; a magnet component comprising at least one magnet; said magnet having two poles; said magnet producing a magnetic flux from each pole; the magnetic flux of said magnet component being at least 2000 gauss; a magnet shield attached to one pole of the magnet to limit flux through the shield; and a plate attracted to said magnet component, said magnet component and said plate being aligned in the holder so that the plate is captured by the magnet component; said magnet shield and said plate having mass and dimensions such that substantially none of the magnetic flux produced by said magnet component permeates through said plate, said shield, and said plastic.

6. The holder in claim 5 in which the dimensions of said plate are minimized so as to minimize weight while maintaining the shielding effect of said plate.

7. The holder in claim 5 in which the thickness of said plate is less than 1/20 inch.

8. The holder in claim 5 in which said plate has approximate dimensions of 17/16 inches by 11/16 inch and an approximate thickness of 1/25 inch.

9. The holder in claim 5 in which said plate weighs less than one half of an ounce.

10. The holder in claim 5 in which said magnet component and magnet shield together weigh less than one half of an ounce.

11. A magnetic card holder comprising a pocket for receiving a card; a tab attached to a backside of the pocket; a magnet component comprising at least one magnet; said magnet having two poles: said magnet producing a magnetic flux from each pole; a magnet shield attached to one pole of the magnet to limit flux through the shield; and a plate attracted to said magnet component, said magnet component and said plate being aligned in the holder so that the plate is captured by the magnet component; said magnet component is positioned between said magnet shield and said metal plate; said magnet component produces a magnetic flux of over 2000 gauss; and a magnetic flux of less than 70 gauss is measurable on the opposite side of the magnet shield and less than 70 gauss on the opposite side of the metal plate.

12. The holder in claim 11 in which substantially no magnetic flux is measurable inside said pocket when the magnetic card holder is in use.

13. The holder in claim 11 in which substantially none of said magnetic flux is measurable on objects held in a user's clothing pocket when the magnetic card holder is attached to said clothing pocket.

14. The holder of claim 11 in which the ratio of the total weight of the holder to the collective weight of the magnets, shield, and plate is approximately two to one.

15. A holder comprising a pocket for receiving a card; a tab for overlying the pocket; a magnet component; a magnet shield mounted to one side of the magnet component; and a plate positioned to be attracted to said magnet component; the total weight of the holder being less than one ounce; said magnet component comprising two magnets; each having one pole attached to one side of said magnet shield; and a magnetic flux of at most 70 gauss being measurable on the opposite side of said shield.

16. The holder in claim 15 in which the weight of said magnet component is less than half of the total weight of the card holder.

17. The holder in claim 15 with said magnet component comprising two neodymium magnets.

18. A holder comprising a pocket for receiving a card; a tab for overlying the pocket; a magnet component; a magnet shield mounted to one side of the magnet component; and a plate positioned to be attracted to said magnet component; the total weight of the holder being less than one ounce; said magnet component comprising two magnets attached to one side of said magnet shield and positioned such that the magnetic flux of each magnet interacts with the other magnet's flux to direct and limit the magnetic flux produced by said magnets.

19. A holder comprising a pocket for receiving a card; a tab for overlying the pocket; a magnet component; a magnet shield mounted to one side of the magnet component; and a plate positioned to be attracted to said magnet component; the total weight of the holder being less than one ounce; said magnet component comprising two cylindrical magnets with each having a diameter of approximately ¼ inch and a thickness of approximately ⅛ inch mounted on one side of said magnet shield with centers of the magnets being spaced approximately ⅝ inch apart.

20. A holder comprising a plastic pocket for receiving a card; a plastic tab for overlying the pocket; a magnet component; a magnet shield mounted to one side of the magnet component; and a plate positioned to be attracted to said magnet component; the total weight of the holder being less than one ounce; said magnet shield and said plate having sufficient mass and dimensions such that substantially none of the magnetic flux produced by said magnet component permeates through said plate, said shield, and said plastic.

21. The holder in claim 20 in which the dimensions of said plate are minimized so as to minimize the weight of said plate while maintaining the shielding effect of said plate to not adversely affect a card positioned in said pocket.

22. The holder in claim 20 in which the thickness of said plate is less than 1/20 inch.

23. The holder in claim 20 in which said plate has approximate dimensions of 1 7/16 inches by 11/16 inch and an approximate thickness of 1/25 inch.

24. The holder in claim 20 in which said plate weighs less than one half of an ounce.

25. The holder in claim 20 in which said magnet and magnet shield together weigh less than one half of an ounce.

26. A holder comprising a pocket for receiving a card; a tab for overlying the pocket; a magnet component; a magnet shield mounted to one side of the magnet component; and a plate positioned to be attracted to said magnet component; the total weight of the holder being less than one ounce; said magnet component being positioned between said magnet shield and said plate; said magnet component produces a magnetic flux of over 3000 gauss; and a magnetic flux of less than 70 gauss is measurable on the opposite side of the magnet shield and less than 70 gauss on the opposite side of the plate.

27. The holder in claim 26 in which substantially no magnetic flux is measurable inside said pocket when the magnetic card holder is in use.

28. The holder in claim 26 in which substantially none of said magnetic flux is measurable on objects held in a user's clothing pocket when the magnetic card holder is attached to said clothing pocket.

29. The holder of claim 26 in which the ratio of the total weight of the holder to the collective weight of the magnets, shield, and plate is approximately two to one.

30. A holder comprising a pocket; a tab; a magnet component comprising two magnets, each magnet having two poles exerting a magnetic flux; the magnetic flux of said magnet component being at least 3000 gauss; a magnet shield attached to said magnets, one pole of each magnet being attached to one side of said magnet shield, and a magnetic flux of at most 70 gauss being measurable on the opposite side of said shield; and a plate positioned to be attracted to said magnets; said holder having a total weight of less than one ounce.

31. The holder in claim 30 in which the weight of said magnet is less than half of the weight of the card holder.

32. The holder in claim 30 in which the pocket and tab are made of plastic.

33. The holder in claim 32 with said magnet shield and said plate having sufficient mass and dimensions such that substantially none of the magnetic flux produced by said magnet component permeates through said plate, said shield, and said plastic.

34. The holder in claim 30 in which the dimensions of said plate are minimized so as to minimize the weight of said plate while maintaining the shielding effect of said plate.

35. The holder in claim 30 in which the thickness of said plate is less than 1/20 inch.

36. The holder in claim 35 in which said plate has approximate dimensions of 1 7/16 inches by 11/16 inch and an approximate thickness of 1/25 inch.

37. The holder in claim 30 in which said plate weighs less than one half of an ounce.

38. The holder in claim 30 in which said magnets and shield together weigh less than one half of an ounce.

39. A holder comprising a pocket; a tab; a magnet component comprising two magnets; said magnets having two poles exerting a magnetic flux; the magnetic flux of said component being at least 3000 gauss; a magnet shield; said magnets being attached to one side of said magnet shield and positioned such that the magnetic flux of each magnet interacts with the other magnet's flux to direct and limit the total effective magnetic flux produced; and a plate positioned to be attracted to said magnet; said holder having a total weight of less than one ounce.

40. A holder comprising a pocket; a tab; a magnet component comprising two cylindrical magnets with diameters of approximately ¼ inch and heights of approximately ⅛ inch; said magnets having two poles exerting a magnetic flux; the magnetic flux of said component being at least 3000 gauss; a magnet shield; said magnets being mounted on one side of said magnet shield with centers spaced approximately ⅝ inch apart; and a plate positioned to be attracted to said magnet; said holder having a total weight of less than one ounce.

41. A holder comprising a pocket; a tab; a magnet component; said magnet component having two poles exerting a magnetic flux; a magnet shield attached to said magnet component; and a plate positioned to be attracted to said magnet; said holder having a total weight of less than one ounce; said magnet component is positioned between said shield and said plate; said magnet component produces a magnetic flux of over 3000 gauss; and a magnetic flux of less than 70 gauss is measurable on the opposite side of the magnet shield and less than 70 gauss on the opposite side of the plate.

42. The holder in claim 41 in which substantially no magnetic flux is measurable inside said pocket when the holder is in use.

43. The holder in claim 41 in which substantially none of said magnetic flux is measurable on objects held in a user's clothing pocket when the magnetic card holder is attached to said clothing pocket.

44. The holder of claim 41 in which the ratio of the total weight of the holder to the collective weight of the magnet component, shield, and plate is approximately two to one.

45. A magnetic card holder comprising a pocket sized to fit an identification card, a tab attached to said pocket, two magnets, a plate attached to said pocket, a magnet shield attached to said magnets and positioned on said tab, the shield having dimensions of approximately 3/8 inch by 1 inch with a thickness of approximately 1/16 inch, said magnets being cylindrical each having a diameter of approximately 1/4 inch and thickness of approximately 1/8 inch, said having centers spaced approximately 5/8 inch, a metal plate mounted to said pocket and having dimensions of approximately 1 7/16 inches by 11/16 inch and an approximate thickness of 1/25 inch, said magnets and shield together weighing approximately 3/10 ounce, said plate weighing approximately 1/5 ounce, and said holder weighing approximately 4/5 ounce.

46. A magnetic card holder comprising: a front wall; a back wall lying in face-to-face relation with the front wall; said walls being joined at some edges to create a card pocket defined by said walls and said edges; said card pocket being sized to permit the insertion of a card; a compartment joined to said back wall; a tab joined to an upper portion of said back wall; a compartment joined to said tab; two neodymium magnets mounted spaced from each other on a magnet shield, the shield and the magnets being sized to fit within at least one of said compartments; a metal plate sized to fit within the other one of said compartments; said magnets having a magnetic force exerting an attractive force on said plate when said plate is near said magnets; said magnet shield, said walls, and said plate jointly absorbing substantially all of said magnetic force.

47. A magnetic card holder comprising a card receiver; a magnet component producing a magnetic flux of at least 2000 gauss; a magnet shield attached to the magnet to limit flux through the shield to at most 70 gauss; and a plate attracted to said magnet component, one of said magnet component and said plate being carried by said receiver and the other one of said magnet component and said plate is configured with a user's clothing captured between the plate and the magnet component so that the plate is captured by the magnet component.

* * * * *

UNITED STATES PATENT AND TRADEMARK OFFICE

CERTIFICATE OF CORRECTION

PATENT NO. : 6,684,544 B1
DATED : February 3, 2004
INVENTOR(S) : Bruce J. Buettell It is certified that error appears in the above-identified patent and that said Letters Patent is hereby corrected as shown below:

Column 4,
Line 42, after "poles" delete ":" and insert -- ; --, therefor.

Signed and Sealed this

Twentieth Day of September, 2005

JON W. DUDAS
*Director of the United States Patent and Trademark Office*